US005953032A

United States Patent [19]

Haarz et al.

[11] Patent Number: 5,953,032

[45] **Date of Patent: *Sep. 14, 1999**

[54] METHOD FOR FORMING AND INSPECTING A BARRIER LAYER OF AN INK JET PRINT CARTRIDGE

[75] Inventors: Leea Danielle Haarz; Tonya Harris Jackson; Jeanne Marie Saldanha Singh, all of Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/872,509

[22] Filed: Jun. 10, 1997

[51] Int. Cl.[6] ..... B41J 2/175

[52] U.S. Cl. ..... 347/87

[58] Field of Search ..... 347/20, 47, 50, 347/87; 29/890.1

[56] References Cited

U.S. PATENT DOCUMENTS

| | | | |
|---|---|---|---|
| 5,439,956 | 8/1995 | Noguchi | 522/92 |
| 5,442,386 | 8/1995 | Childers et al. | 347/50 |
| 5,519,421 | 5/1996 | Barr et al. | 347/47 |
| 5,538,586 | 7/1996 | Swanson et al. | 156/307.6 |
| 5,604,521 | 2/1997 | Merkel et al. | 347/47 |

OTHER PUBLICATIONS

G. L. Fillmore & A. R. Hoffman, "Ink Jet Nozzle Mounting", from IBM Technical Disclosure Bulletin, Apr., 1977, vol. 19, No. 11.

*Primary Examiner*—N. Le
*Assistant Examiner*—Anh T. N. Vo
*Attorney, Agent, or Firm*—John A. Brady

[57] ABSTRACT

A process is provided for forming a barrier layer over one or more extending sections of a flexible circuit and one or more bond pads of a print cartridge printhead using an encapsulant material and subsequently inspecting the print cartridge to determine if the encapsulant material has been properly placed on the print cartridge. The process involves providing an inspection mark on an orifice plate of the printhead before the barrier layer is formed. After the barrier layer has been formed, an inspection is made to determine if the barrier layer extends beyond the inspection mark and contacts a second portion of the print cartridge. If it does, then the print cartridge is unacceptable. If not, then the print cartridge is acceptable. Alternatively, the location of the barrier layer may be considered unacceptable if it contacts any portion of the inspection mark even though it may not contact the second portion of the print cartridge.

32 Claims, 4 Drawing Sheets

METHOD FOR FORMING AND INSPECTING A BARRIER LAYER OF AN INK JET PRINT CARTRIDGE

FIELD OF THE INVENTION

This invention relates to a method for forming a barrier layer on a portion of an ink jet print cartridge using an encapsulant material and subsequently inspecting the barrier layer to determine if it is properly positioned on the print cartridge.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and an orifice plate having a plurality of the discharge orifices formed therein. The printhead forms part of an ink jet print cartridge which also comprises an ink-filled container.

The resistors are individually addressed by energy pulses provided by a printer energy supply circuit. Each energy pulse is applied to one of the resistors to momentarily vaporize the ink in contact with that resistor to form a bubble which expels an ink droplet. A flexible circuit is used to provide a path for the energy pulses to travel from the printer energy supply circuit to the printhead. The flexible circuit includes a substrate portion and a plurality of traces located on the substrate portion. The traces have end sections which extend out from the substrate portion. The extending sections are coupled to bond pads on the printhead. Typically, there is a first row of coupled bond pads and trace sections and an opposing, second row of coupled bond pads and trace sections.

It is known in the art to form a barrier layer over each row of coupled bond pads and extending trace sections. One known process for forming such a barrier layer involves dispensing an encapsulant material onto the coupled bond pads and trace sections using a discharge needle.

Once a barrier layer has been formed over each row of coupled bond pads and extending trace sections, an inspection is made to determine if each barrier layer is properly positioned on the print cartridge. If one of the barrier layers is improperly positioned on the print cartridge, the layer may block one or more of the orifices. Also, if the spacing between the two barrier layers is too narrow, wiping of the orifice plate surface may be made more difficult.

One known method for conducting an inspection for proper barrier layer placement involves measuring the distance from a center portion of the orifice plate to an inner edge of the barrier layer. If the distance is less than a predetermined value, then the barrier layer is improperly located and the print cartridge is unacceptable. Such an inspection is not easily accomplished in a high volume manufacturing environment and, hence, has been found to be undesirable. Accordingly, there is a need for an improved process for inspecting barrier layer placement on an ink jet print cartridge.

SUMMARY OF THE INVENTION

This need is met by the present invention, wherein an improved process is provided for forming a barrier layer over a first portion of a print cartridge using an encapsulant material and subsequently inspecting the print cartridge to determine if the encapsulant material has been properly positioned over the print cartridge first portion. The first portion of the print cartridge comprises one or more extending sections of a flexible circuit, one or more bond pads of a print cartridge printhead, and an outer section of the printhead. The process involves providing an inspection mark on an orifice plate of the printhead before the barrier layer is formed. After the barrier layer has been formed, an inspection is made to determine if the barrier layer extends beyond the inspection mark and contacts a second portion of the print cartridge. If it does, then the print cartridge is unacceptable. If not, then the print cartridge is acceptable. Alternatively, the location of the barrier layer may be considered unacceptable if it contacts any portion of the inspection mark even though it may not contact the second portion of the print cartridge

DETAILED DESCRIPTION OF THE PREFERRED EMBODIMENT

Figure 1:
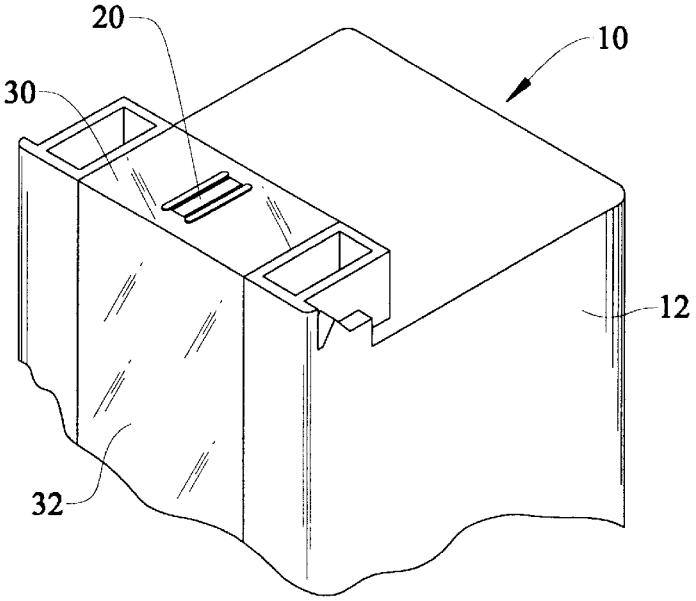
FIG. 1 is a perspective view of a portion of an ink jet print cartridge formed in accordance with the present invention.

Referring now to FIG. 1, there is shown an ink jet print cartridge 10 constructed in accordance with the present invention. It is adapted to be used in an ink jet printer. The print cartridge 10 comprises an ink-filled polymeric container 12, a printhead 20 which is adhesively secured to the container 12, and a flexible circuit 30.

Figure 2:
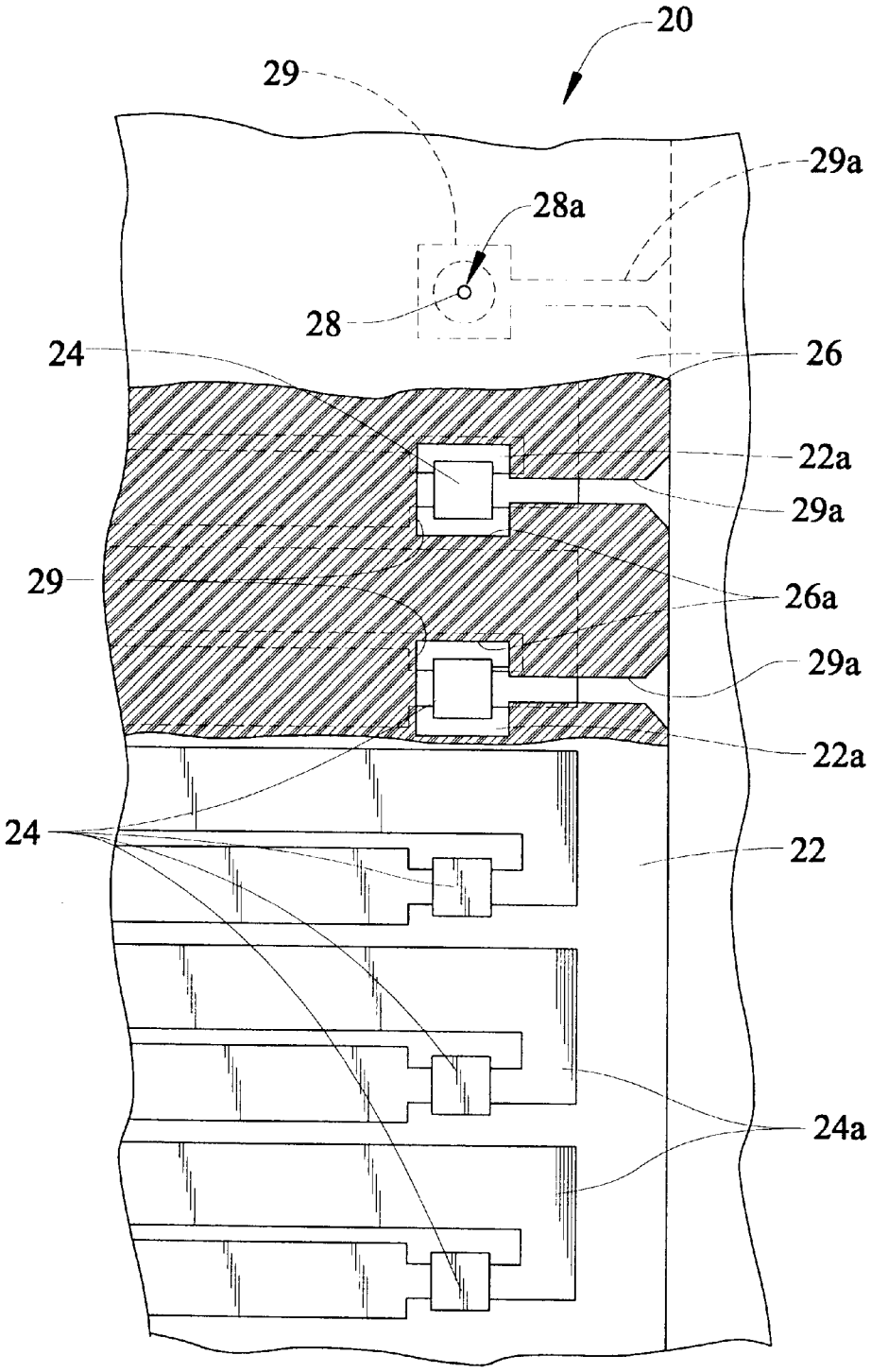
FIG. 2 is a view of a portion of a heater chip coupled to an orifice plate with sections of the orifice plate removed at two different levels.

The printhead 20 comprises a heater chip 22 provided with a plurality of resistive heating elements 24, see FIG. 2. The printhead 20 further includes an orifice plate 26 having a plurality of openings 28 extending through it which define a plurality of orifices 28*a* through which ink droplets are ejected. Sections 26*a* of the plate 26 and portions 22*a* of the heater chip 22 define a plurality of bubble chambers 29. Ink supplied by the container 12 flows into the bubble chambers 29 through ink supply channels 29*a*.

The resistive heating elements 24 are individually addressed by voltage pulses. Each voltage pulse is applied to a heating element 24 to momentarily vaporize the ink in contact with the heating element 24 to form a bubble within the chamber 29 in which the heating element 24 is located. The function of the bubble is to displace ink within the chamber 29 such that a droplet of ink is expelled through the bubble chamber orifice 28*a* associated with that chamber 29.

Figure 3B:
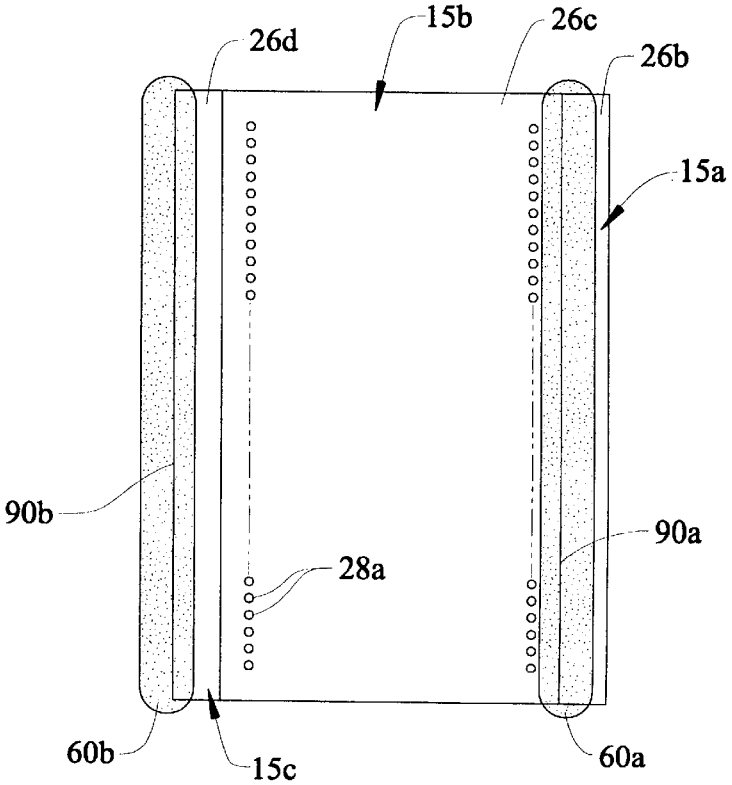
FIG. 3B is a schematic view of a printhead and first and second barrier layers illustrating improper placement of the first barrier layer.
Figure 3A:
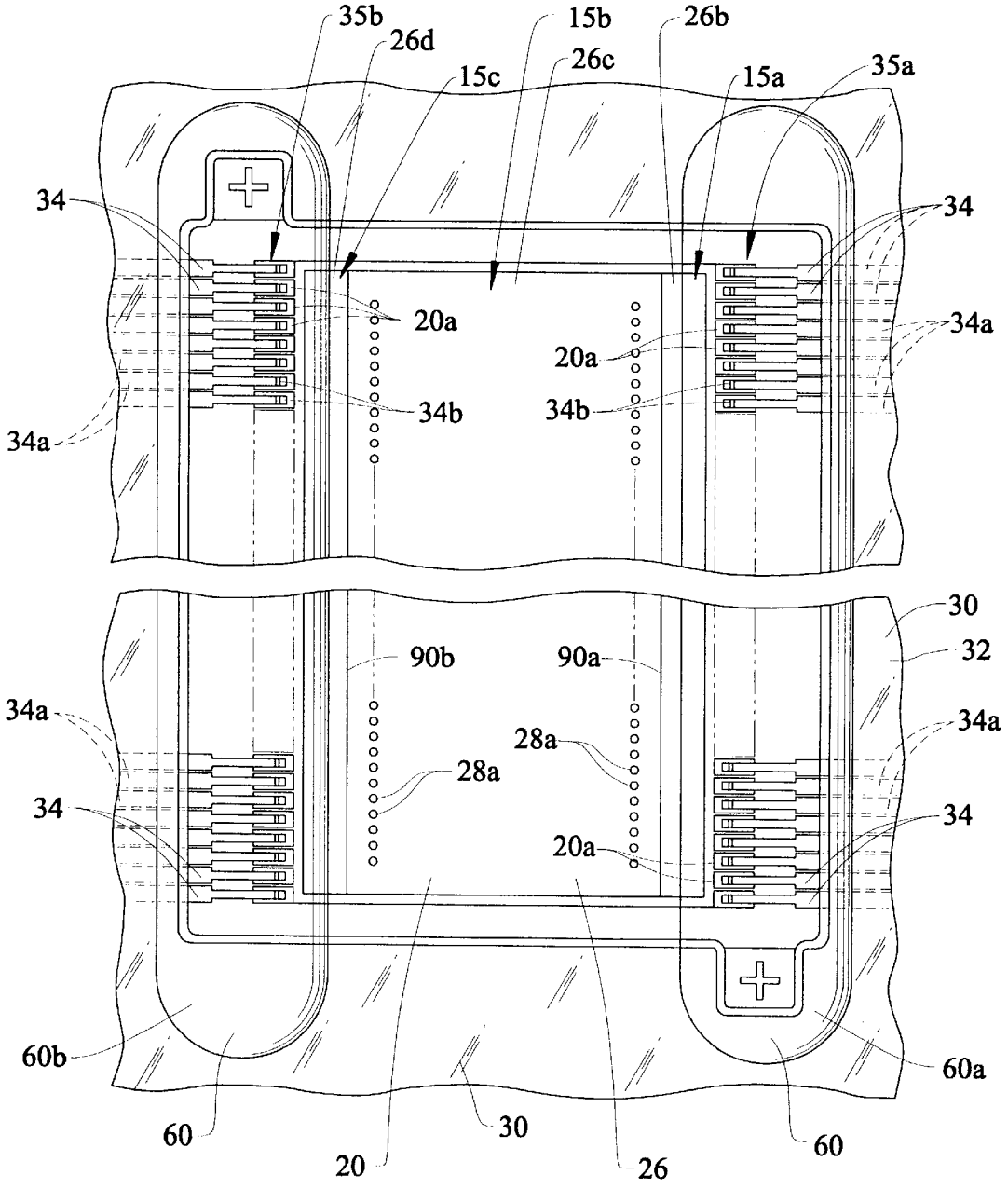
FIG. 3A is an enlarged view of the printhead, a portion of the flexible circuit, and a portion of the ink-filled container shown in FIG. 1.

The flexible circuit 30 provides a path for voltage pulses to travel from a printer energy supply circuit (not shown) to bond pads 20*a*, see FIG. 3A, provided on the printhead 20. Conductors 24*a* extend from the bond pads 20*a* to the heating elements 24, see FIG. 2.

Figure 5:
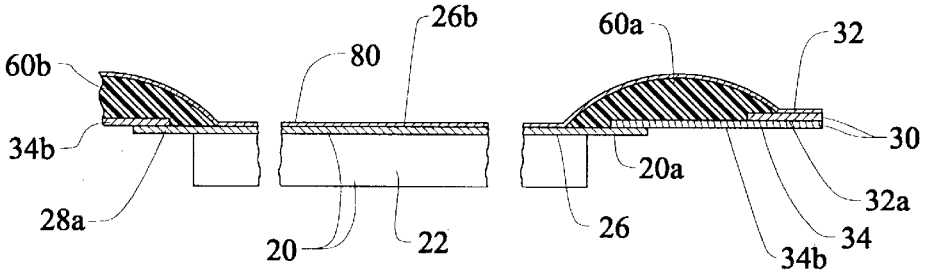
FIG. 5 is a view taken along view line 5—5 in FIG. 4.

The flexible circuit 30 comprises a substrate portion 32 having a plurality of metallic traces 34 formed on a first side 32*a* thereof, see FIGS. 3A and 5. The traces 34 have main body sections 34*a* and end sections 34*b*. The end sections 34*b* define beam leads. The main body sections 34*a* are formed on the substrate portion 32 and the end sections 34*b* extend out from the substrate portion 32. The first side 32*a* of the substrate portion 32 faces the container 12 such that the main body sections 34*a* are positioned between the substrate portion 32 and the container 12. An epoxy coating (not shown) may be applied over the main body sections 34*a* so as to prevent ink from contacting those sections 34*a*.

The extending end sections 34*b* are coupled to the bond pads 20*a* via a conventional Tape Automated Bonding (TAB) bonding process. Preferably, the TAB bonding process is performed before either the printhead 20 or the flexible circuit 30 is secured to the container 12. Typically, there is a first row 35*a* of coupled bond pads 20*a* and trace sections 34*b* and an opposing, second row 35*b* of coupled bond pads 20*a* and trace sections 34*b*, see FIG. 3A.

The polymeric container 12 may be formed from polyphenylene oxide, which is commercially available from the General Electric Company under the trademark "NORYL SE-1." The substrate portion 32 is preferably formed from a polymeric material, such as a polyimide material commercially available from E.I. DuPont de Nemours & Co. under the trademark "KAPTON." In the illustrated embodiment, the metallic traces 34 are gold-coated copper traces. The specific materials from which the container 12, the substrate portion 32 and the metallic traces 34 are formed are mentioned herein for illustrative purposes only. Hence, in this invention, the materials from which these elements are formed are not intended to be limited to the specific ones disclosed herein.

The orifice plate 26 may be formed from a flexible polymeric material which is adhered to the heater chip 22 via an adhesive (not shown). Examples of polymeric materials from which the orifice plate 26 may be formed and adhesives for securing the plate 26 to the heater chip 22 are set out in commonly assigned patent application, U.S. Ser. No. 08/519,906, entitled "METHOD OF FORMING AN INK-JET PRINTHEAD NOZZLE STRUCTURE," by Tonya H. Jackson et al., filed on Aug. 28, 1995, Attorney Docket No. LE9-95-024, the disclosure of which is hereby incorporated by reference. As noted therein, the plate 26 may be formed from a polymeric material such as polyimide, polyester, fluorocarbon polymer, or polycarbonate, which is preferably about 15 to about 200 microns thick. Examples of commercially available plate materials include a polyimide material available from E.I. DuPont de Nemours & Co. under the trademark "KAPTON" and a polyimide material available from Ube (of Japan) under the trademark "UPILEX." The adhesive may comprise any B-stageable thermal cure resin including phenolic resins, resorcinol resins, urea resins, epoxy resins, ethylene-urea resins, furane resins, polyurethanes, and silicone resins. Other suitable adhesive materials include macromolecular thermoplastic, or hot melt, materials such as ethylene-vinyl acetate, ethylene ethylacrylate, polypropylene, polystryrene, polyamides, polyesters and polyurethanes.

In accordance with the present invention, first and second inspection marks 90*a* and 90*b* are formed on the orifice plate 26 before the plate 26 is adhered to the heater chip 22. In the illustrated embodiment, the marks 90*a* and 90*b* comprise substantially straight, solid lines. Alternatively, the marks 90*a* and 90*b* may comprise substantially straight, dotted lines, curvilinear lines, one or more small symbols or any other visible mark. The marks 90*a* and 90*b* are preferably formed on the polymeric plate 26 by a laser scribing operation using, for example, a YAG laser, a $CO_2$ laser, or an excimer laser. Alternatively, the marks 90*a* and 90*b* may be formed using a conventional cutting blade, die or punch. The depth of each mark 90*a* and 90*b* into the plate 26 is preferably from about 1 micron to about 25 microns for a plate 26 having a thickness of from about 25 microns to about 200 microns, more preferably from about 50 microns to about 100 microns, and most preferably about 63 microns.

It is believed that an inspection mark having a depth of about 1 to about 15 microns (preferably 3–5 microns) may be laser scribed into a polyimide orifice plate using an excimer laser in the following manner. Laser scribing would be accomplished at an energy density level of about 850 millijoules/$cm^2$. A laser beam having a wavelength of about 248 nanometers would be applied in pulses over a predefined time period, e.g., about 5–50, preferably 10–30, and most preferably 10–15 pulses applied over a time period of about one second.

The first inspection mark 90*a* extends between first and second portions 15*a* and 15*b* of the print cartridge 10, see FIG. 3A. The first portion 15*a* of the print cartridge 10 comprises the first row 35*a* of coupled bond pads 20*a* and trace sections 34*b* and a first outer section 26*b* of the orifice plate 26. The second portion 15*b* of the print cartridge 10 comprises a second inner section 26*c* of the orifice plate 26. The second inspection mark 90*b* extends between the second portion 15*b* of the print cartridge 10 and a third portion 15*c* of the cartridge 10. The third portion 15*c* comprises the second row 35*b* of coupled bond pads 20*a* and trace sections 34*b* and a third outer section 26*d* of the orifice plate 26.

Alternatively, the orifice plate 26 may comprise a metal plate. For example, the plate 26 may comprise a nickel base having a gold-plated upper layer. The first and second marks 90*a* and 90*b* may be formed in the metal plate 26 via a conventional etching or like process.

In the illustrated embodiment, a die-attach adhesive (not shown), such as a heat curable epoxy-based polymer, is secured to a printhead receiving portion (not shown) of the container 12 so as to secure the printhead 20 to the container 12. A free-standing pressure sensitive adhesive film (not shown) may be used to secure the flexible circuit 30 to the container 12. A more detailed discussion of the manner in which the printhead 20 and the flexible circuit 30 are secured to the polymeric container 12 can be found in commonly assigned, copending patent application, U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," by Singh et al., filed on Mar. 27, 1997, and having Attorney Docket No.LE9-97-038, the disclosure of which is hereby incorporated by reference.

After the printhead 20 and the flexible circuit 30 have been attached to the container 12 but before the die-attach adhesive is cured, a bead of liquid encapsulant material 60 is applied over each of the two rows 35*a* and 35*b* of coupled bond pads 20*a* and extending trace sections 34*b*. The liquid encapsulant material is preferably dispensed through a dispensing needle 70, see FIG. 6. The needle may have an oval cross section as set out in the above mentioned patent application entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL."

Figure 6:
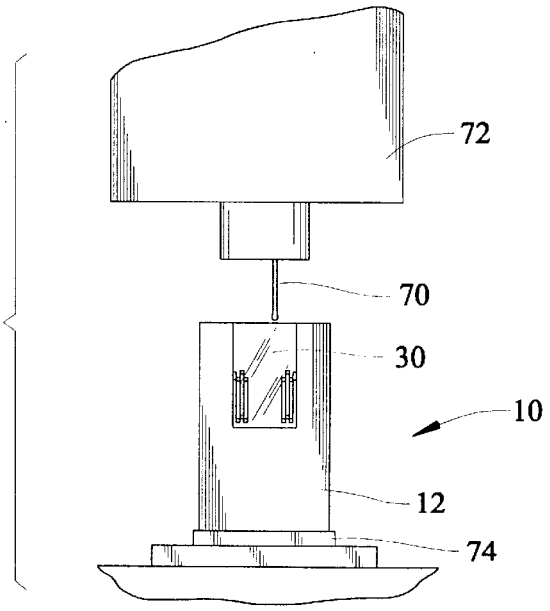
FIG. 6 is a side view of an encapsulant material dispensing apparatus and an ink jet print cartridge wherein the cartridge is shown positioned to receive encapsulant material from the dispensing apparatus.

As is illustrated in FIG. 6, the dispensing needle 70 may be attached to a conventional dispensing apparatus 72 having a dispense pump (not shown) which forces encapsulant material 60 from a tube of encapsulant material (not shown) into and through the dispensing needle 70. The apparatus 72 also has a traversing mechanism (not shown) which moves the needle 70 along dispensing paths so as to allow the needle 70 to deposit the material 60 along the two rows 35*a* and 35*b*. A workpiece holder 74 is provided to fixedly hold the container 12 beneath the dispensing needle 70. It is also contemplated that the material 60 may be manually dispensed through the needle 70 using a conventional syringe. Preferably, the encapsulant material 60 is dispensed onto the first and third portions 15*a* and 15*c* of the print cartridge 10 without contacting the second portion 15*b* of the print cartridge 10.

The encapsulant material 60 forms a first barrier layer 60*a* over row 35*a* and a second barrier layer 60*b* over row 35*b*. The encapsulant material 60 may comprise any polymeric material which, after it has substantially solidified or cured, is capable of forming an effective mechanical and chemical barrier layer over each of the two rows 35*a* and 35*b* of coupled bond pads 20*a* and extending trace sections 34*b*. The barrier layers 60*a* and 60*b* protect the bond pads 20*a* which, in the illustrated embodiment, are made from aluminum, from corrosion due to exposure to ink. The barrier layers 60*a* and 60*b* further protect the bond pads 20*a* and extending sections 34*a* during ink removal from the plate 26 via a conventional polymeric wiper (not shown) which forms part of the printer. The encapsulant material 60 may comprise a urethane acrylate material which is commercially available from Grace Specialty Polymers Division of W.R. Grace and Company under the trademark "UNISET UV-9000." This material is an ultraviolet light (UV) cured material and has a viscosity of about 11,000 centipoise at about 25° C. when measured with a Brookfield viscometer, Model HATB. Other thermoset or thermoplastic encapsulant materials not specifically set out herein may also be used.

After the beads of encapsulant material 60 have been applied to the two rows 35*a* and 35*b* of coupled bond pads 20*a* and extending trace sections 34*b*, the encapsulant material 60 is cured or allowed to solidify. Thereafter, the die-attach adhesive is cured by placing the cartridge 10 in a heated oven maintained at a temperature of about 110° C. for approximately 45 minutes.

The first and second barrier layers 60*a* and 60*b* are inspected to determine if they are properly positioned on the print cartridge 10. The inspection of the barrier layers 60*a* and 60*b* may take place after the die-attach adhesive has cured.

Initially, a first inspection is made to determine if the first barrier layer 60*a* extends beyond the first inspection mark 90*a* and contacts the second portion 15*b* of the print cartridge 10. Further, a second inspection is made to determine if the second barrier layer 60*b* extends beyond the second inspection mark 90*b* and contacts the second portion 15*b* of the print cartridge 10. The barrier layers 60*a* and 60*b* and inspection marks 90*a* and 90*b* are viewed using, for example, a video microscope (not shown) which generates an output signal provided to either a monitor for analysis by human vision or to an optical analyzer for analysis by an electronic device. It is also contemplated that an operator may view the barrier layers 60*a* and 60*b* and inspection marks 90*a* and 90*b* through an eyepiece of a standard microscope. The encapsulant material 60 should be clear or, if colored with a dye, sufficiently transparent so that the inspection marks 90*a* and 90*b* can be seen through the barrier layers 60*a* and 60*b*.

If the spacing between the two barrier layers 60*a* and 60*b* is too narrow, proper tape sealing may not occur. Also, taping of the printhead 20, which will be described below, is made more difficult. It should also be noted that if one of the barrier layers 60*a* and 60*b* is improperly positioned on the print cartridge 10, that layer may cover one or more of the orifices 28*a* such that ink will not pass through the covered orifice or orifices during printing. Hence, the first and second inspection marks 90*a* and 90*b* should be located on the orifice plate 26 such that if the two barrier layers 60*a* and 60*b* are properly positioned relative to the inspection marks 90*a* and 90*b*, none of the orifices 28*a* will be covered by encapsulant material and the barrier layers 60*a* and 60*b* will not inhibit wiping and taping operations.

In the example illustrated in FIG. 3A, the first barrier layer 60*a* is properly positioned over the first portion 15*a* of the print cartridge 10 and does not contact the first inspection mark 90*a*. Similarly, the second barrier layer 60*b* is properly positioned over the third portion 15*c* of the print cartridge 10 and does not contact the second inspection mark 90*b*. Hence, the print cartridge 10 in the FIG. 3A example is acceptable.

In the example illustrated in FIG. 3B, the first barrier layer 60*a* is not properly positioned on the print cartridge 10 as it clearly extends beyond the first inspection mark 90*a* and contacts the second portion 15*b* of the print cartridge 10. The second barrier layer 60*b* is properly positioned over the third print cartridge portion 15*c* as it does not contact the second inspection mark 90*b*. However, because the first barrier layer 60*a* is improperly located on the print cartridge 10, the print cartridge 10 in the FIG. 3A example is considered unacceptable.

Alternatively, the location of the barrier layer 60*a* may be considered unacceptable if it contacts any portion of the inspection mark 90*a* but does not engage the second portion 15*b*. Similarly, the location of the barrier layer 60*b* may be considered unacceptable if it contacts any portion of the inspection mark 90*b* even though it may not engage the second portion 15*b*.

Figure 4:
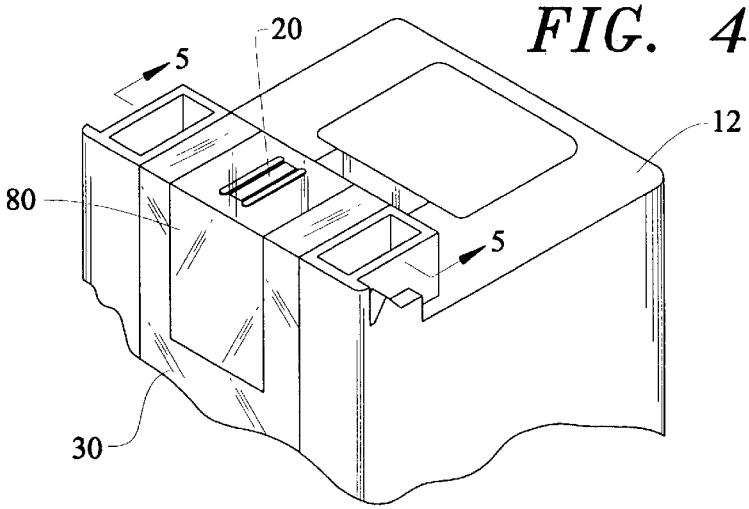
FIG. 4 is a perspective view of a portion of an ink jet print cartridge formed in accordance with the present invention having a length of sealing tape provided thereon.

In the illustrated embodiment, sealing tape 80 is applied over the printhead 20, see FIGS. 4 and 5, to seal the orifices 28*a* from ink leakage until the tape 80 is removed just prior to installation of the cartridge 10 in an ink jet printer (not shown).

What is claimed is:

1. A method for accepting an ink jet print cartridge comprising the steps of:

providing an inspection mark on said ink jet print cartridge which is positioned between said first portion and a second portion of said print cartridge;

dispensing an encapsulant material onto said first portion where said encapsulant material normally does not extend past said inspection mark, said dispensed encapsulant material forming a barrier layer over said first portion;

optically inspecting said inspection mark and said encapsulant material to determine the location of said encapsulant material with respect to said inspection mark; and accepting said cartridge when said encapsulant material does not extend past a predetermined side of said inspection mark.

2. A method as set forth in claim 1, wherein said inspection mark comprises a substantially straight line.

3. A method as set forth in claim 1, wherein said inspection mark comprises one of a dotted line and a symbol.

4. A method as set forth in claim 1, wherein said providing step comprises the step of laser scribing said ink jet print cartridge to form said inspection mark on said print cartridge.

5. A method as set forth in claim 1, wherein said ink jet print cartridge comprises:

a polymeric container for receiving ink;

a printhead coupled to said container and having at least one bond pad;

a flexible circuit including a substrate portion and at least one conductor trace on said substrate portion and having an end section which extends out from said substrate portion to define at least one beam lead, said at least one beam lead being coupled to said at least one bond pad; and said first portion comprising said at least one bond pad, said at least one beam lead and an outer section of said printhead and said second portion comprising an inner section of said printhead.

6. A method as set forth in claim 1, wherein said dispensing step comprises the step of moving one of a dispensing element and said first portion relative to the other such that a bead of said encapsulant material is applied to said first portion.

7. A method as set forth in claim 1, wherein said dispensing step comprises the step of dispensing a polymeric material onto said first portion.

8. A method as set forth in claim 1, wherein said ink jet print cartridge comprises:

a polymeric container for receiving ink;

a printhead coupled to said container and having a first row of bond pads located on a first side of said printhead and a second row of bond pads located on a second, opposite side of said printhead; and a flexible circuit including a substrate portion and a plurality of conductor traces provided on said substrate portion and having end sections which extend out from said substrate portion to define first and second rows of beam leads, said first row of beam leads being coupled to said first row of bond pads and said second row of beam leads being coupled to said second row of bond pads, said coupled first bond pads and beam leads and a first outer section of said printhead defining said first portion, a second inner section of said printhead defining said second portion and said coupled second bond pads and beam leads and a third outer section of said printhead defining a third portion of said print cartridge.

9. A method for accepting an ink jet print cartridge comprising the steps of:

providing an inspection mark on said ink jet print cartridge which is positioned between said first portion and a second portion of said print cartridge;

dispensing an encapsulant material onto said first portion where said encapsulant material normally does not extend beyond said inspection mark and contact said second portion, said dispensed encapsulant material forming a barrier layer over said first portion;

optically inspecting said inspection mark and said encapsulant material to determine the location of said encapsulant material with respect to said inspection mark; and accepting said cartridge when said encapsulant material does not extend past a predetermined side of said inspection mark.

10. A method as set forth in claim 9, wherein said inspection mark comprises a substantially straight line.

11. A method as set forth in claim 9, wherein said inspection mark comprises one of a dotted line and a symbol.

12. A method as set forth in claim 9, wherein said providing step comprises the step of laser scribing said ink jet print cartridge to form said inspection mark on said print cartridge.

13. A method as set forth in claim 9, wherein said ink jet print cartridge comprises:

a polymeric container for receiving ink;

a printhead coupled to said container and having at least one bond pad;

a flexible circuit including a substrate portion and at least one conductor trace on said substrate portion and having an end section which extends out from said substrate portion to define at least one beam lead, said at least one beam lead being coupled to said at least one bond pad; and said first portion comprising said at least one bond pad, said at least one beam lead and an outer section of said printhead and said second portion comprising an inner section of said printhead.

14. A method as set forth in claim 9, wherein said dispensing step comprises the step of moving one of a dispensing element and said first portion relative to the other such that a bead of said encapsulant material is applied to said first portion.

15. A method as set forth in claim 9, wherein said dispensing step comprises the step of dispensing a polymeric material onto said first portion.

16. A method as set forth in claim 9, wherein said ink jet print cartridge comprises:

a polymeric container for receiving ink;

a printhead coupled to said container and having a first row of bond pads located on a first side of said printhead and a second row of bond pads located on a second, opposite side of said printhead; and a flexible circuit including a substrate portion and a plurality of conductor traces provided on said substrate portion and having end sections which extend out from said substrate portion to define first and second rows of beam leads, said first row of beam leads being coupled to said first row of bond pads and said second row of beam leads being coupled to said second row of bond pads, said coupled first bond pads and beam leads and a first outer section of said printhead defining said first portion, a second inner section of said printhead defining said second portion and said coupled second bond pads and beam leads and a third outer section of said printhead defining a third portion of said print cartridge.

17. A method for accepting an ink jet print cartridge comprising the steps of:

providing an inspection mark on said ink jet print cartridge which is positioned between said first portion and a second portion of said print cartridge;

dispensing an encapsulant material onto said first portion where said encapsulant material forms a barrier layer over said first portion;

optically inspecting said barrier layer to determine if said barrier layer contacts said inspection mark;

accepting said ink jet print cartridge when said inspection determines that said barrier layer does not contact said inspection mark; and not accepting said ink jet print cartridge when said inspection determines when said barrier layer contacts said inspection mark.

18. A method as set forth in claim 17, wherein said inspection mark comprises a substantially straight line.

19. A method as set forth in claim 17, wherein said inspection mark comprises a substantially straight dotted line.

20. A method as set forth in claim 17, wherein said providing step comprises the step of laser scribing said ink jet print cartridge to form said inspection mark on said print cartridge.

21. A method as set forth in claim 17, wherein said ink jet print cartridge comprises:

a polymeric container for receiving ink;

a printhead coupled to said container and having at least one bond pad;

a flexible circuit including a substrate portion and at least one conductor trace on said substrate portion and having an end section which extends out from said substrate portion to define at least one beam lead, said at least one beam lead being coupled to said at least one bond pad; and said first portion comprising said at least one bond pad, said at least one beam lead and an outer section of said printhead and said second portion comprising an inner section of said printhead.

22. A method as set forth in claim 17, wherein said dispensing step comprises the step of moving one of a dispensing element and said first portion relative to the other such that a bead of said encapsulant material is applied to said first portion.

23. A method as set forth in claim 17, wherein said dispensing step comprises the step of dispensing a polymeric material onto said first portion.

24. A method as set forth in claim 17, wherein said ink jet print cartridge comprises:

a polymeric container for receiving ink;

a printhead coupled to said container and having a first row of bond pads located on a first side of said printhead and a second row of bond pads located on a second, opposite side of said printhead; and a flexible circuit including a substrate portion and a plurality of conductor traces provided on said substrate portion and having end sections which extend out from said substrate portion to define first and second rows of beam leads, said first row of beam leads being coupled to said first row of bond pads and said second row of beam leads being coupled to said second row of bond pads, said coupled first bond pads and beam leads and a first outer section of said printhead defining said first portion, a second inner section of said printhead defining said second portion and said coupled second bond pads and beam leads and a third outer section of said printhead defining a third portion of said print cartridge.

25. A method for accepting an ink jet print cartridge comprising the steps of:

providing an inspection mark on said ink jet print cartridge which is positioned between said first portion and a second portion of said print cartridge;

dispensing an encapsulant material onto said first portion such that said encapsulant material forms a barrier layer over said first portion;

optically inspecting said barrier layer to determine if said barrier layer extends beyond said inspection mark and contacts said second portion;

accepting said ink jet print cartridge when said inspection determines that said barrier layer does not contact said second portion; and not accepting said ink jet print cartridge when said barrier layer contacts said second portion.

26. A method as set forth in claim 25, wherein said inspection mark comprises a substantially straight line.

27. A method as set forth in claim 25, wherein said inspection mark comprises a substantially straight dotted line.

28. A method as set forth in claim 25, wherein said providing step comprises the step of laser scribing said ink jet print cartridge to form said inspection mark on said print cartridge.

29. A method as set forth in claim 25, wherein said ink jet print cartridge comprises:

a polymeric container for receiving ink;

a printhead coupled to said container and having at least one bond pad;

a flexible circuit including a substrate portion and at least one conductor trace on said substrate portion and having an end section which extends out from said substrate portion to define at least one beam lead, said at least one beam lead being coupled to said at least one bond pad; and said first portion comprising said at least one bond pad, said at least one beam lead and an outer section of said printhead and said second portion comprising an inner section of said printhead.

30. A method as set forth in claim 25, wherein said dispensing step comprises the step of moving one of a dispensing element and said first portion relative to the other such that a bead of said encapsulant material is applied to said first portion.

31. A method as set forth in claim 25, wherein said dispensing step comprises the step of dispensing a polymeric material onto said first portion.

32. A method as set forth in claim 25, wherein said ink jet print cartridge comprises:

a polymeric container for receiving ink;

a printhead coupled to said container and having a first row of bond pads located on a first side of said printhead and a second row of bond pads located on a second, opposite side of said printhead; and a flexible circuit including a substrate portion and a plurality of conductor traces provided on said substrate portion and having end sections which extend out from said substrate portion to define first and second rows of beam leads, said first row of beam leads being coupled to said first row of bond pads and said second row of beam leads being coupled to said second row of bond pads, said coupled first bond pads and beam leads and a first outer section of said printhead defining said first portion, a second inner section of said printhead defining said second portion and said coupled second bond pads and beam leads and a third outer section of said printhead defining a third portion of said print cartridge.

* * * * *